US005895517A

United States Patent [19]

Kawamura et al.

[11] Patent Number: 5,895,517

[45] Date of Patent: Apr. 20, 1999

[54] SINTERED FE ALLOY FOR VALVE SEAT

[75] Inventors: Osamu Kawamura; Takashi Kawamoto; Hiroshi Oshige, all of Shimotsuga-gun, Japan

[73] Assignee: Nippon Piston Ring Co., Ltd., Japan

[21] Appl. No.: 08/911,282

[22] Filed: Aug. 14, 1997

[30] Foreign Application Priority Data

| | | | |
|---|---|---|---|
| Aug. 14, 1996 | [JP] | Japan | 8-232559 |
| Jun. 19, 1997 | [JP] | Japan | 9-178955 |
| Jul. 8, 1997 | [JP] | Japan | 9-199204 |

[51] Int. Cl.[6] ..... C22C 33/00

[52] U.S. Cl. ..... 75/246; 75/243; 75/244

[58] Field of Search ..... 75/243, 244, 246

[56] References Cited

U.S. PATENT DOCUMENTS

| | | | |
|---|---|---|---|
| 4,363,662 | 12/1982 | Takahashi et al. | 75/243 |
| 4,588,441 | 5/1986 | Ikenoue et al. | 75/230 |
| 4,678,510 | 7/1987 | Jandeska et al. | 75/244 |
| 4,702,771 | 10/1987 | Takagi et al. | 75/241 |
| 5,158,601 | 10/1992 | Fujiki et al. | 75/246 |
| 5,256,184 | 10/1993 | Kosco et al. | 75/246 |
| 5,326,526 | 7/1994 | Ikenoue et al. | 419/38 |

OTHER PUBLICATIONS

Patent Abstract of Japan, GRP No. C1199, vol. No. 18, 251, May 13, 1994.

*Primary Examiner*—Ngoclan Mai

*Attorney, Agent, or Firm*—Nixon & Vanderhye

[57] ABSTRACT

A sintered Fe alloy for a valve seat is made of a prepared powdery alloy which comprises C of from 0.3 wt. % to 1.6 wt. %, Cu of from 5 wt. % to 20 wt. %, hard particle of from 5 wt. % to 40 wt. % which consists of at least one species selected from ferroalloy, ceramic and intermetallic compound, and a balance which is a powdery Fe atomizing alloy containing at least one species of from 1 wt. % to 8 wt. % selected from Cr and Mo. The prepared powdery alloy containing the above-mentioned component and content is subject to a press forming process by a compression molding to form a green compact body which is then sintered. The sintered Fe alloy has a high thermal conductivity, a high strength at a high temperature and an excellent abrasion resistance, and, moreover, can be used for a valve seat provided in a high function engine.

8 Claims, 9 Drawing Sheets

SINTERED FE ALLOY FOR VALVE SEAT

BACKGROUND OF THE INVENTION

The present invention relates to a sintered Fe alloy which may suitably be used as a material for forming a valve seat to be used for an internal combustion engine, and more specifically to the sintered Fe alloy as the material for forming the valve seat with a requirement of the internal combustion engine with high power and high rotation.

A valve seat has a conical surface portion to which a valve is abutted and is a component part of an internal combustion engine. The valve seat is formed by processing of a cylinder material or a head casting material and by fit of a ring formed beforehand. In either case, the valve seat is required to improve a thermal conductivity and a strength at a high temperature.

Hitherto, there has generally been used a sintered Fe alloy, as the material for forming the valve seat wherein the strength at a high temperature and the abrasion resistance thereof have been improved in order to solve the requirement described above. There have been known, for example, a sintered Fe alloy obtained in a manner that Co, Ni, Cr, W, Mo, V or the like is added to a base powder (powdery raw material) of Fe to make a mixed powder (green compact body) which is then press-formed and thereafter is sintered, and a sintered Fe alloy is obtained in a manner that a hard particle such as ferroalloy, carbide, intermetallic compound or the like is added to the base powder of Fe to make the mixed powder which is then press-formed and thereafter is sintered. Further, there has been known a sintered Fe alloy to which an infiltration treatment of Cu, Pb or the like is carried out for improving a thermal conductivity and a strength and for giving a self-lubricity.

However, the latest valve seat must endure hard conditions in comparison with a conventional valve seat, with the requirement of the latest internal combustion engine with high rotation and high power. Therefore, a higher abrasion resistance is required for the valve seat.

In case that infiltration treatment of Cu is carried out for improvement of the function of the combustion engine, there is a problem that the manufacturing cost of the valve seat becomes high for a reason described below; in the first place, a powdery alloy for forming the valve seat is sintered to form a green compact body, and in the final place, the green compact body is again put in a furnace with a Cu green compact body composing of a simple pressed powdery Cu or a pressed powdery Cu alloy to infiltrate the Cu component into the green compact body. Therefore, the process of forming Cu powder and the two heat treatments in the furnace must be done. In case that the infiltration treatment of Pb is carried out for improvement of the function of the combustion engine, there is a problem that the manufacturing cost of the valve seat becomes high because the infiltration treatment is needed in addition to the sintered treatment, and Pb may give a bad influence to the environment.

SUMMARY OF THE INVENTION

The present invention was made in view of the above-mentioned circumstances. An object of the present invention is therefore to provide a sintered Fe alloy which has a high thermal conductivity, a high strength at a high temperature and an excellent abrasion resistance, and, moreover, can be used for a valve seat provided in a high function internal combustion engine.

For the purpose of attainment of the aforementioned object of the present invention, a sintered Fe alloy consists of a prepared powdery alloy which comprises C of from 0.3 wt. % to 1.6 wt. %, Cu of from 5 wt. % to 20 wt. %, a hard particle of from 5 wt. % to 40 wt. % which consists of at least one species selected from ferroalloy, ceramic and intermetallic compound, and a balance which is a powdery Fe atomizing alloy containing at least one species of from 1 wt. % to 8 wt. % selected from Cr and Mo. The sintered Fe alloy is formed by sintering of a green compact body so formed that the prepared powdery alloy containing the above-mentioned components and content is subject to a press forming process by a compression molding.

The balance which is the powdery Fe atomizing alloy further may comprise at least one species selected from Ni of 4 wt. % or below, W of 4 wt. % or below, V of 4 wt. % or below, Mn of 1 wt. % or below, Ti of 1 wt. % or below and B of 1 wt. % or below, and the total content of above-mentioned components thereof may be 5 wt. % or below with respect to the total weight of the sintered Fe alloy.

A sintered Fe alloy consists of a prepared powdery alloy which comprises C of the content described above, Cu of the content described above, a hard particle of the content described above which consists of at least one species selected from ferroalloy, ceramic and intermetallic compound, and a balance which is a powdery Fe atomizing alloy. The powdery Fe atomizing alloy comprises a powdery atomizing alloy containing Co of from 1 wt. % to 10 wt. %. The sintered Fe alloy is formed by sintering of a green compact body so formed that the prepared powdery alloy containing the above-mentioned components and content is subject to a press forming process by a compression molding.

The balance which is the powdery Fe atomizing alloy containing Co of from 1 wt. % to 10 wt. %, further may comprise at least one species selected from Ni of the content of 4 wt. % or below, W of the content of 4 wt. % or below, V of the content of 4 wt. % or below, Cr of the content of 4 wt. % or below, Mo of the content of 4 wt. % or below, Mn of the content of 1 wt. % or below, Ti of the content of 1 wt. % or below, B of the content of 1 wt. % or below and the total content of above-mentioned components thereof is preferably 5 wt. % or below with respect to the total weight of the sintered Fe alloy.

The above-mentioned sintered Fe alloy preferably contains the Fe-Mo (ferroalloy) content of 10 wt. % or above in the hard particle described above to improve the strength at a high temperature and the abrasion resistance.

The above-mentioned sintered Fe alloy preferably has a density of 7.0 g/cm$^3$ or above to improve the strength and the abrasion resistance.

The sintered Fe alloy of the present invention for the valve seat is made of the powdery raw material previously containing the powdery Cu component of from 5 wt. % to 20 wt. %, so that, an infiltration treatment of Cu is not necessary. Therefore, the forming process of Cu powder is omitted, the heat treatment in a furnace is needed only once, the manufacturing cost of the sintered Fe alloy of the present invention for the valve seat is lower than that of the conventional valve seat material in which heat treatment in a furnace is carried out twice to improve a thermal conductivity and a strength at a high temperature, and the sintered Fe alloy thus obtained is led to a homogeneous metallurgical structure. Further, with a density of 7.0g/cm$^3$ or above, the sintered Fe alloy with the excellent abrasion resistance is obtained.

DESCRIPTION OF THE PREFERRED EMBODIMENTS

Figure 1:
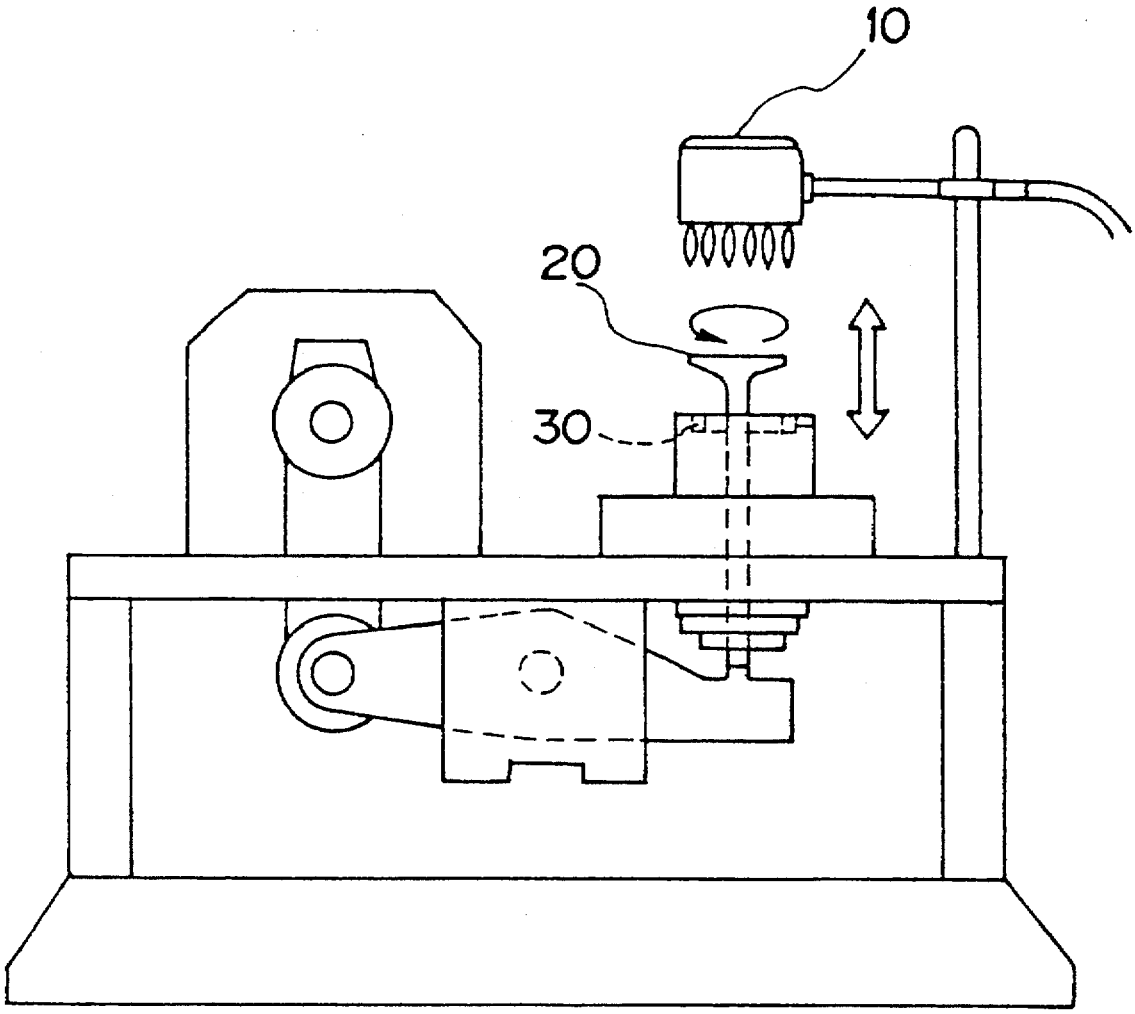
FIG. 1 is a schematic view illustrating an abrasion testing apparatus to be used in Experiment Examples and Comparative Examples as described hereinafter.

Now, chemical composition and other features of a sintered Fe alloy which is utilized for a valve seat, of the present invention will be described in detail below.

A sintered Fe alloy of the present invention for the valve seat is made of a prepared powdery alloy which comprises C of from 0.3 wt. % to 1.6 wt. %, Cu of from 5 wt. % to 20 wt. %, a hard particle of from 5 wt. % to 40 wt. % which consists of at least one species selected from ferroalloy, ceramic and intermetallic compound, and a balance being a powdery Fe atomizing alloy containing at least one species of from 1 wt. % to 8 wt. % selected from Cr and Mo.

In the sintered Fe alloy of the present invention, a C component contained therein has a function to maintain a sintering property and a strength of the sintered Fe alloy for the valve seat.

A content of the C component having the function described above is from 0.3 wt. % to 1.6 wt. %, more preferably from 0.6 wt. % to 1.3 wt. %. With the C content of under 0.3 wt. %, the sintering property decreases to cause an insufficient precipitation of a carbide, so that an abrasion resistance may not be sufficiently improved. With the C content of over 1.6 wt. %, on the other hand, the strength of the sintered Fe alloy decreases, and cementite may precipitate to cause an insufficient machinability. From the standpoint of a homogeneousness of a metallurgical structure and the sintering property of a prepared green compact body, the C content is preferably from 0.6 wt. % to 1.3 wt. %.

A Cu component contained therein has a function to improve a thermal conductivity and a strength at a high temperature. A content of the Cu component having the function described above is from 5 wt. % to 20 wt. %, more preferably from 8.5 wt. % to 15 wt. %. With the Cu content of under 5 wt. %, the sintering property decreases, and, moreover, there may occur hardly a residual Cu to cause an insufficient thermal conductivity. With the Cu content of over 20 wt. %, on the other hand, the strength of the sintered Fe alloy decreases while the residual Cu increases, so that the abrasion resistance may not be sufficiently improved.

The sintered Fe alloy contains a hard particle of from 5 wt. % to 40 wt. % which consists of at least one species selected from ferroalloy, ceramic and intermetallic compound. The hard particle contained in the sintered Fe alloy has a function to improve the abrasion resistance, and the homogeneous dispersing hard particle has a function to improve uniformly the abrasion resistance.

The content of the hard particle having the function described above is from 5 wt. % to 40 wt. %, more preferably from 10 wt. % to 15 wt. %. With the hard particle of under 5 wt. %, a sufficient abrasion resistance may not be imparted to the sintered Fe alloy. With the hard particle of over 40 wt. %, on the other hand, there is a tendency of decrease of strength and density due to the decrease of the sintering property.

The powdery Fe atomizing alloy as the balance, containing at least one species of from 1 wt. % to 8 wt. % selected from Cr and Mo, more preferably from 2.0 wt. % to 6.0 wt. % has a function as powdery base materials (corresponding to claim 1). With the content thereof of under 1.0 wt. %, the strength of the sintered Fe alloy decreases, and the sufficient abrasion resistance cannot be obtained. With the content thereof of over 8 wt. %, on the other hand, the moldability of the green compact body decreases, so that the strength thereof decreases. From the standpoint of the moldability of the green compact body, the metallurgical structure and the machinability, particularly, the content thereof is preferably from 2.0 wt. % to 6.0 wt. %.

The powdery Fe atomizing alloy as the balance, further comprises at least one species selected from Ni of 4 wt. % or below, W of 4 wt. % or below, V of 4 wt. % or below, Mn of 1 wt. % or below, Ti of 1 wt. % or below and B of 1 wt. % or below, and the total content of above-mentioned components thereof may be 5 wt. % or below with respect to the total weight of the sintered Fe alloy (corresponding to claim 2).

The Ni component contained therein has a function to improve the heat resistance and the corrosion resistance. With the Ni content of over 4 wt. %, however, austenite may precipitate to cause an insufficient abrasion resistance.

The W component contained therein has a function to improve the strength at a temperature and the abrasion resistance. With the W content of over 4 wt. %, however, the moldability of the green compact body and the machinability decrease.

The V component contained therein has a function similar to that of W described above. With the V content of over 4 wt. %, however, the moldability of the green compact body and the machinability decrease. The Mn component contained therein has a function to improve the strength. With the Mn content of over 1 wt. %, however, the moldability of the green compact body decreases.

The Ti component contained therein has a function to improve the abrasion resistance due to a precipitation hardening. With the Ti content of over 1 wt. %, however, the machinability and the moldability of the green compact body decrease. The B component contained therein has a function similar to that of Ti described above. With the B content of over 1 wt. %, the machinability and the moldability of the green compact body decrease.

When the total content of at least one species selected from Ni, W, V, Mn, Ti and B is over 5 wt. % with respect to the total weight of the sintered Fe alloy, the moldability of the green compact body and the machinability decrease.

The prepared powdery alloy comprises C of the content described above, Cu of the content described above, hard particle of the content described above of at least one species selected from ferroalloy, ceramic and intermetallic compound, and the balance which is the powdery Fe atomizing alloy. The powdery Fe atomizing alloy comprises a powdery atomizing alloy containing Co of from 1 wt. % to 10 wt. % (corresponding to claim 3). With the Co content of under 1 wt. %, the sufficient abrasion resistance and the strength at a high temperature cannot be obtained. With the Co content of over 10 wt. %, the abrasion resistance thereof remarkably decreases with an austenite transformation.

The powdery Fe atomizing alloy as the balance, containing therein Co of from 1 wt. % to 10 wt. %, further comprises at least one species selected from Ni of the content of 4 wt. % or below, W of the content of 4 wt. % or below, V of the content of 4 wt. % or below, Cr of the content of 4 wt. % or below, Mo of the content of 4 wt. % or below, Mn of the content of 1 wt. % or below, Ti of the content of 1 wt. % or below, B of the content of 1 wt. % or below and the total content of above-mentioned components thereof is preferably 5 wt. % or below with respect to the total weight of the sintered Fe alloy (corresponding to claim 4). The function and the limit content of Ni, W, V, Mn, Ti and B are similar to those of the powdery Fe atomizing alloy described above (corresponding to claim 2).

The Cr component contained therein has a function to improve the heat resistance and the abrasion resistance. With the Cr content of over 4 wt. %, however, the machinability and the moldability of the green compact body decrease. The Mo component contained therein has a function to improve the strength at a high temperature and the abrasion resistance. With the Mo content of over 4 wt. %, however, the moldability of the green compact body and the machinability decrease. When the total content of at least one species selected from Ni, W, V, Cr, Mo, Mn, Ti and B is over 5 wt. % with respect to the total weight of the sintered Fe alloy, the moldability of the green compact body and the machinability decrease.

It is preferable to contain Fe-Mo (ferroalloy) of 10 wt. % or above in the hard particle described above to improve the strength at a high temperature and the abrasion resistance (corresponding to claim 5).

The density of the sintered Fe alloy obtained, furthermore, is preferably 7.0 g/cm$^3$ or above to improve the strength and the abrasion resistance (corresponding to the claim 6).

The sintered Fe alloy of the present invention for the valve seat is formed by sintering of the prepared green compact body so formed that the prepared powdery alloy containing the above-mentioned components and content is subject to a press forming process by a compression molding.

In a concrete example, the powdery raw material is so obtained that the powdery electrodeposited Cu as the Cu component described above, graphite as the C component described above and hard particle of from 5 wt. % to 40 wt. % consisting of at least one species selected from ferroalloy, ceramic and intermetallic compound are added at a predetermined content ratio to the powdery Fe atomizing alloy as the balance, containing at least one species of from 1 wt. % to 8 wt. % selected from Cr and Mo. A lubricant for improving a mold releasing property at a time of metal mold forming is added to the powdery raw material to prepare the mixed powdery alloy. Further, the mixed prepared powdery alloy is subjected to the compression molding, and, thereafter, a dewaxing treatment, a sintering treatment and an annealing treatment are performed in this order. Thus, the sintered Fe alloy of the present invention can be obtained for the valve seat.

The sintering temperature is 1100 to 1200° C., more preferably 1150 to 1180° C., and the sintering time is 15 to 45 minutes in general.

The annealing treatment is carried out for adjusting a hardness of the sintered Fe alloy obtained and for preventing a change of property at a high temperature. The annealing temperature is 600 to 700° C. in general, and the annealing time is 2 to 3 hours in general.

The sintered Fe alloy thus obtained of the present invention for the valve seat has a function to improve the heat conductivity, the strength at a high temperature and the abrasion resistance.

EXAMPLES

Now, the present invention will be described hereinbelow in more detail with reference to Experiment Examples and Comparative Examples.

As shown in Table 1-1 to Table 1-4, Experiment Examples 1 to 40 of the present invention were prepared with respect to each component. In Experiment Example 1, for example, a powdery raw material was so prepared that a powdery electrodeposited Cu of 13 wt. % and a powdery graphite of 0.5 wt. % were added to a powdery Fe containing uniformly Cr of 3 wt. % as solid solution.

TABLE 1-1

| | Prepared powdery alloy (wt. %) | | | | | | | | | | | |
|---|---|---|---|---|---|---|---|---|---|---|---|---|
| | ① | ② | ③ | ④ | ⑤ | ⑥ | ⑦ | ⑧ | ⑨ | ⑩ | ⑪ | ⑫ |
| Ex-Ex. 1 | Bal. | | | | | | | | | | | |
| Ex-Ex. 2 | Bal. | | | | | | | | | | | |
| Ex-Ex. 3 | Bal. | | | | | | | | | | | |
| Ex-Ex. 4 | Bal. | | | | | | | | | | | |
| Ex-Ex. 5 | Bal. | | | | | | | | | | | |
| Ex-Ex. 6 | Bal. | | | | | | | | | | | |
| Ex-Ex. 7 | | Bal. | | | | | | | | | | |
| Ex-Ex. 8 | | Bal. | | | | | | | | | | |
| Ex-Ex. 9 | | Bal. | | | | | | | | | | |
| Ex-Ex. 10 | | | Bal. | | | | | | | | | |

TABLE 1-1-continued

| | Prepared powdery alloy (wt. %) | | | | | | | | | | | |
|---|---|---|---|---|---|---|---|---|---|---|---|---|
| | ① | ② | ③ | ④ | ⑤ | ⑥ | ⑦ | ⑧ | ⑨ | ⑩ | ⑪ | ⑫ |
| Ex-Ex. 11 | | | Bal. | | | | | | | | | |
| Ex-Ex. 12 | | | Bal. | | | | | | | | | |
| Ex-Ex. 13 | | | Bal. | | | | | | | | | |
| Ex-Ex. 14 | | | Bal. | | | | | | | | | |
| Ex-Ex. 15 | | | Bal. | | | | | | | | | |
| Ex-Ex. 16 | Bal. | | | | | | | | | | | |
| Ex-Ex. 17 | Bal. | | | | | | | | | | | |
| Ex-Ex. 18 | Bal. | | | | | | | | | | | |
| Ex-Ex. 19 | | Bal. | | | | | | | | | | |
| Ex-Ex. 20 | | | Bal. | | | | | | | | | |

*) Ex-Ex.: Experiment Example, Co-Ex.: Comparative Example
*) Bal.: balance is powdery Fe atomizing alloy:
① 3Cr, ② 5Mo, ③ 3Cr—1Mo, ④ 3Cr—1Mo—2Ni, ⑤ 3Cr—1W, ⑥ 3Cr—1V, ⑦ 3Cr—1Mo—0.5Mn, ⑧ 5Mo—0.5B, ⑨ 6Co—1Ni, ⑩ 6Co—1Ni, ⑪ 6Co—1V—1Mo, ⑫ Fe

TABLE 1-2

| | Prepared powdery alloy (wt. %) | | | | | | | | | | | |
|---|---|---|---|---|---|---|---|---|---|---|---|---|
| | ① | ② | ③ | ④ | ⑤ | ⑥ | ⑦ | ⑧ | ⑨ | ⑩ | ⑪ | ⑫ |
| Ex-Ex. 21 | | | | Bal. | | | | | | | | |
| Ex-Ex. 22 | | | | Bal. | | | | | | | | |
| Ex-Ex. 23 | | | | Bal. | | | | | | | | |
| Ex-Ex. 24 | | | | Bal. | | | | | | | | |
| Ex-Ex. 25 | | | | | Bal. | | | | | | | |
| Ex-Ex. 26 | | | | | Bal. | | | | | | | |
| Ex-Ex. 27 | | | | | Bal. | | | | | | | |
| Ex-Ex. 28 | | | | | | Bal. | | | | | | |
| Ex-Ex. 29 | | | | | | Bal. | | | | | | |
| Ex-Ex. 30 | | | | | | Bal. | | | | | | |
| Ex-Ex. 31 | | | | | | | Bal. | | | | | |
| Ex-Ex. 32 | | | | | | | Bal. | | | | | |
| Ex-Ex. 33 | | | | | | | Bal. | | | | | |
| Ex-Ex. 34 | | | | | | | | Bal. | | | | |
| Ex-Ex. 35 | | | | | | | | | Bal. | | | |
| Ex-Ex. 36 | | | | | | | | | Bal. | | | |
| Ex-Ex. 37 | | | | | | | | | Bal. | | | |
| Ex-Ex. 38 | | | | | | | | | | Bal. | | |
| Ex-Ex. 39 | | | | | | | | | | Bal. | | |
| Ex-Ex. 40 | | | | | | | | | | | Bal. | |
| Co-Ex. 1 | | | Bal. | | | | | | | | | |
| Co-Ex. 2 | | | Bal. | | | | | | | | | |
| Co-Ex. 3 | | | Bal. | | | | | | | | | |
| Co-Ex. 4 | | | | | | | | | | | | Bal. |
| Co-Ex. 5 | | | | | | | | | | | | Bal. |

*) Ex-Ex.: Experiment Example, Co-Ex.: Comparative Example
*) Bal.: balance is powdery Fe atomizing alloy:
① 3Cr, ② 5Mo, ③ 3Cr—1Mo, ④ 3Cr—1Mo—2Ni, ⑤ 3Cr—1W, ⑥ 3Cr—1V, ⑦ 3Cr—1Mo—0.5Mn, ⑧ 5Mo—0.5B, ⑨ 6Co—1Ni, ⑩ 6Co—1Ni, ⑪ 6Co—1V—1Mo, ⑫ Fe

TABLE 1-3

| | Hard particle (wt. %) | | | | C | Cu | Others |
|---|---|---|---|---|---|---|---|
| | ⑬ | ⑭ | ⑮ | ⑯ | (wt. %) | (wt. %) | (wt. %) |
| Ex-Ex. 1 | | | | 15 | 0.5 | 13 | |
| Ex-Ex. 2 | | | | 10 | 1.0 | 13 | |
| Ex-Ex. 3 | | | | 15 | 1.0 | 6 | |
| Ex-Ex. 4 | | | | 5 | 1.0 | 13 | |
| Ex-Ex. 5 | | | | 15 | 1.0 | 20 | |
| Ex-Ex. 6 | | | | 10 | 1.4 | 13 | |
| Ex-Ex. 7 | | | | 10 | 0.6 | 13 | |
| Ex-Ex. 8 | | | | 10 | 1.0 | 13 | |
| Ex-Ex. 9 | | | | 10 | 1.3 | 13 | |
| Ex-Ex. 10 | | | | 15 | 0.5 | 13 | |
| Ex-Ex. 11 | | | | 10 | 1.0 | 13 | |
| Ex-Ex. 12 | | | | 15 | 1.0 | 6 | |

TABLE 1-3-continued

| | Hard particle (wt. %) | | | | C | Cu | Others |
|---|---|---|---|---|---|---|---|
| | ⑬ | ⑭ | ⑮ | ⑯ | (wt. %) | (wt. %) | (wt. %) |
| Ex-Ex. 13 | | | | 5 | 1.0 | 13 | |
| Ex-Ex. 14 | | | | 15 | 1.0 | 20 | |
| Ex-Ex. 15 | | | | 10 | 1.4 | 13 | |
| Ex-Ex. 16 | 10 | 5 | | | 1.0 | 13 | |
| Ex-Ex. 17 | | 15 | | | 1.0 | 13 | |
| Ex-Ex. 18 | 5 | | 10 | | 1.0 | 13 | |
| Ex-Ex. 19 | | 15 | | | 1.0 | 13 | |
| Ex-Ex. 20 | | | 15 | | 1.0 | 13 | |

*) Ex-Ex.: Experiment Example, Co-Ex.: Comparative Example
*) Hard particle: ⑬ ferroalloy, ⑭ ceramic, ⑮ intermetallic compound, ⑯ Fe—Mo

TABLE 1-4

| | Hard particle (wt. %) | | | | C | Cu | Others |
|---|---|---|---|---|---|---|---|
| | (13) | (14) | (15) | (16) | (wt. %) | (wt. %) | (wt. %) |
| Ex-Ex. 21 | 15 | | | | 1.0 | 13 | |
| Ex-Ex. 22 | | 10 | 5 | | 1.0 | 13 | |
| Ex-Ex. 23 | | | | 15 | 0.6 | 13 | |
| Ex-Ex. 24 | | | | 10 | 1.0 | 13 | |
| Ex-Ex. 25 | | | | 10 | 1.0 | 13 | |
| Ex-Ex. 26 | | | 15 | | 1.0 | 6 | |
| Ex-Ex. 27 | 10 | | 5 | | 1.3 | 13 | |
| Ex-Ex. 28 | | | 20 | | 1.0 | 13 | |
| Ex-Ex. 29 | | | | 15 | 0.6 | 13 | |
| Ex-Ex. 30 | | | | 15 | 1.3 | 13 | |
| Ex-Ex. 31 | 15 | | | | 1.0 | 13 | |
| Ex-Ex. 32 | | | | 15 | 1.0 | 6 | |
| Ex-Ex. 33 | | | | 15 | 1.0 | 20 | |
| Ex-Ex. 34 | | | | 30 | 1.0 | 13 | |
| Ex-Ex. 35 | | | 15 | 15 | 1.0 | 13 | |
| Ex-Ex. 36 | 10 | 5 | | | 1.0 | 13 | |
| Ex-Ex. 37 | | 10 | | | 0.6 | 13 | |
| Ex-Ex. 38 | | | 15 | 15 | 0.6 | 13 | |
| Ex-Ex. 39 | | 15 | | | 0.6 | 13 | |
| Ex-Ex. 40 | 15 | | | | 0.6 | 13 | |
| Co-Ex. 1 | | | | 15 | 1.0 | | |
| Co-Ex. 2 | | | | 25 | 1.0 | 10 | |
| Co-Ex. 3 | | | | 15 | 1.0 | 25 | |
| Co-Ex. 4 | | | | | 1.4 | | Ni:2, Co:6, Cr:7 |
| Co-Ex. 5 | | | | | 1.4 | | Cu infiltration into Co-Ex. 4 |

*) Ex-Ex.: Experiment Example, Co-Ex.: Comparative Example
*) Hard particle: (13) ferroalloy, (14) ceramic, (15) intermetallic compound, (16) Fe—Mo Zinc stearate of 0.75 wt. % as a lubricating agent for improving the mold releasing property at a time of metal mold forming was added to each of the powdery raw materials to obtain each mixed powdery alloy.

Each mixed powdery alloy was subjected to a press forming process at a pressure of 8 ton/cm$^2$ to form a green compact body. Thereafter, a dewaxing treatment was carried out to the green compact body at a temperature of 450° C. for a period of time of 30 minutes, and was sintered at a temperature of 1160° C. for a period of time of 30 minutes to form a sintered body.

The sintered body was annealed at a temperature of 630 ° C. for a period of time of 2 hours to obtain a test piece of the sintered Fe alloy for the valve seat.

With respect to each test piece obtained, tests for a density, a radial crushing strength, an amount of abrasion of each test piece and an amount of abrasion of the valve as the object member of the test piece were made. The results of the tests are shown in Table 2-1 and Table 2-2.

TABLE 2-1

| | Density (g/cm$^3$) | Radial crushing strength (kgf/mm$^2$) | Amount of abrasion of test piece (μm) | Amount of abrasion of valve seat (μm) | Total of amount of abrasion of test piece and valve seat (μm) |
|---|---|---|---|---|---|
| Ex-Ex. 1 | 7.18 | 95 | 35 | 4 | 39 |
| Ex-Ex. 2 | 7.25 | 108 | 30 | 5 | 35 |
| Ex-Ex. 3 | 7.11 | 103 | 21 | 6 | 27 |
| Ex-Ex. 4 | 7.26 | 105 | 40 | 9 | 49 |
| Ex-Ex. 5 | 7.10 | 82 | 45 | 1 | 56 |
| Ex-Ex. 6 | 7.19 | 83 | 33 | 6 | 39 |
| Ex-Ex. 7 | 7.27 | 107 | 37 | 8 | 45 |
| Ex-Ex. 8 | 7.25 | 100 | 37 | 5 | 42 |
| Ex-Ex. 9 | 7.26 | 97 | 43 | 7 | 50 |

TABLE 2-1-continued

| | Density (g/cm$^3$) | Radial crushing strength (kgf/mm$^2$) | Amount of abrasion of test piece (μm) | Amount of abrasion of valve seat (μm) | Total of amount of abrasion of test piece and valve seat (μm) |
|---|---|---|---|---|---|
| Ex-Ex. 10 | 7.16 | 85 | 34 | 4 | 38 |
| Ex-Ex. 11 | 7.24 | 102 | 28 | 6 | 34 |
| Ex-Ex. 12 | 7.09 | 104 | 16 | 2 | 18 |
| EX-Ex. 13 | 7.28 | 109 | 39 | 4 | 43 |
| Ex-Ex. 14 | 7.11 | 81 | 42 | 15 | 57 |
| Ex-Ex. 15 | 7.21 | 92 | 35 | 3 | 38 |
| Ex-Ex. 16 | 7.15 | 91 | 45 | 5 | 50 |
| Ex-Ex. 17 | 7.10 | 85 | 48 | 8 | 56 |
| Ex-Ex. 18 | 7.18 | 93 | 40 | 3 | 43 |
| Ex-Ex. 19 | 7.12 | 90 | 42 | 6 | 48 |
| Ex-Ex. 20 | 7.25 | 95 | 38 | 7 | 45 |

*) Ex-Ex.: Experiment Example, Co-Ex.: Comparative Example

TABLE 2-2

| | Density (g/cm$^3$) | Radial crushing strength (kgf/mm$^2$) | Amount of abrasion of test piece (μm) | Amount of abrasion of valve seat (μm) | Total of amount of abrasion of test piece and valve seat (μm) |
|---|---|---|---|---|---|
| Ex-Ex. 21 | 7.24 | 94 | 35 | 5 | 40 |
| Ex-Ex. 22 | 7.11 | 88 | 41 | 4 | 45 |
| Ex-Ex. 23 | 7.22 | 102 | 43 | 4 | 47 |
| Ex-Ex. 24 | 7.18 | 98 | 32 | 5 | 37 |
| Ex-Ex. 25 | 7.19 | 105 | 34 | 2 | 36 |
| Ex-Ex. 26 | 7.14 | 95 | 42 | 6 | 48 |
| Ex-Ex. 27 | 7.19 | 92 | 40 | 3 | 43 |
| Ex-Ex. 28 | 7.09 | 84 | 45 | 8 | 53 |
| Ex-Ex. 29 | 7.20 | 108 | 28 | 1 | 29 |
| Ex-Ex. 30 | 7.17 | 100 | 30 | 4 | 34 |
| Ex-Ex. 31 | 7.20 | 89 | 41 | 9 | 50 |
| Ex-Ex. 32 | 7.13 | 93 | 33 | 2 | 35 |
| Ex-Ex. 33 | 7.26 | 86 | 48 | 7 | 55 |
| Ex-Ex. 34 | 7.05 | 82 | 36 | 10 | 46 |
| Ex-Ex. 35 | 7.20 | 103 | 46 | 3 | 49 |
| Ex-Ex. 36 | 7.16 | 93 | 48 | 7 | 55 |
| Ex-Ex. 37 | 7.18 | 91 | 40 | 2 | 42 |
| Ex-Ex. 38 | 7.23 | 96 | 43 | 5 | 48 |
| Ex-Ex. 39 | 7.26 | 100 | 47 | 6 | 53 |
| Ex-Ex. 40 | 7.18 | 87 | 49 | 3 | 52 |
| Co-Ex. 1 | 6.92 | 90 | 70 | 12 | 82 |
| Co-Ex. 2 | 6.90 | 78 | 75 | 15 | 90 |
| Co-Ex. 3 | 7.29 | 85 | 68 | 17 | 85 |
| Co-Ex. 4 | 6.85 | 54 | 72 | 14 | 86 |
| Co-Ex. 5 | 7.89 | 138 | 30 | 5 | 35 |

*) Ex-Ex.: Experimental Example, Co-Ex.: Comparative Example

An amount of abrasion of each test piece and each valve as the object member of each test piece was measured after the abrasion test with the use of the valve seat abrasion testing apparatus as shown in FIG. 1 under the following conditions. In the valve seat abrasion testing apparatus as shown in FIG. 1, a numerical number 10 is a heat source, a numerical number 20 is the valve and a numerical number 30 is the test piece as the valve seat.

Conditions of the abrasion test

Material of valve:SUH-35

Surface temperature of the test piece to which the valve is abutted:300° C.

Rotation number of cam:3000 rpm

Rotation number of valve:20 rpm

Lifting length of valve:7 mm

Set load:18.9 kgf (at the time of setting); 38.5 kgf (at the time of lifting) Testing time:4.5 hours Experiment Examples 2 to 40

Figure 2:
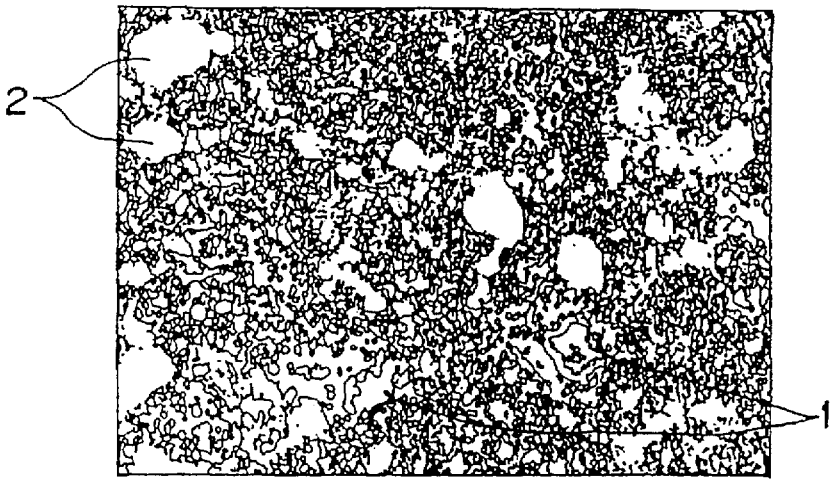
FIG. 2 is a schematic view illustrating a metallurgical structure of a sintered Fe alloy for a valve seat obtained by Experiment Example 4.
Figure 3:
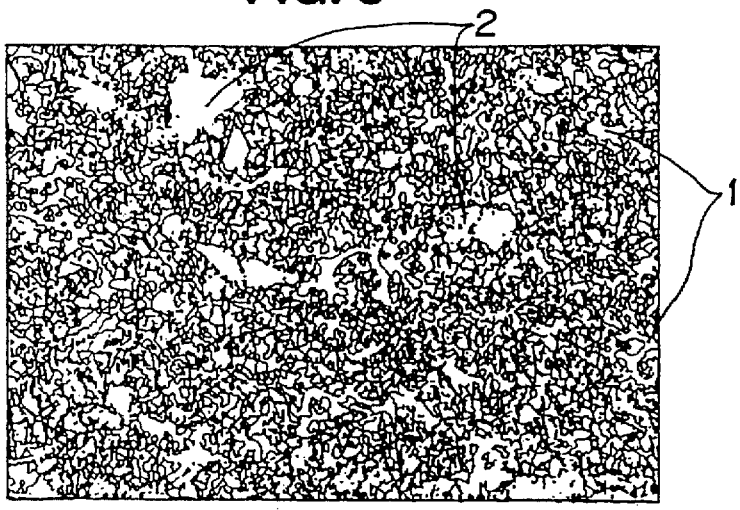
FIG. 3 is a schematic view illustrating a metallurgical structure of a sintered Fe alloy for a valve seat obtained by Experiment Example 8.
Figure 4:
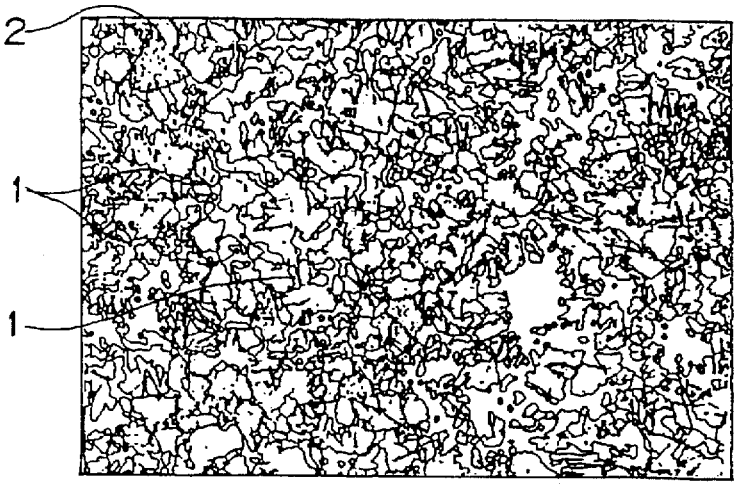
FIG. 4 is a schematic view illustrating a metallurgical structure of a sintered Fe alloy for a valve seat obtained by Experiment Example 13.
Figure 5:
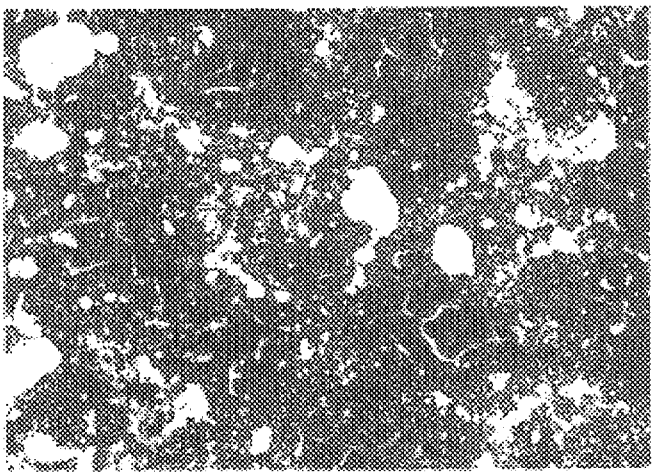
FIG. 5 is a metallographic photograph of the metallurgical structure of the sintered Fe alloy for the valve seat obtained by Experiment Example 4.
Figure 6:
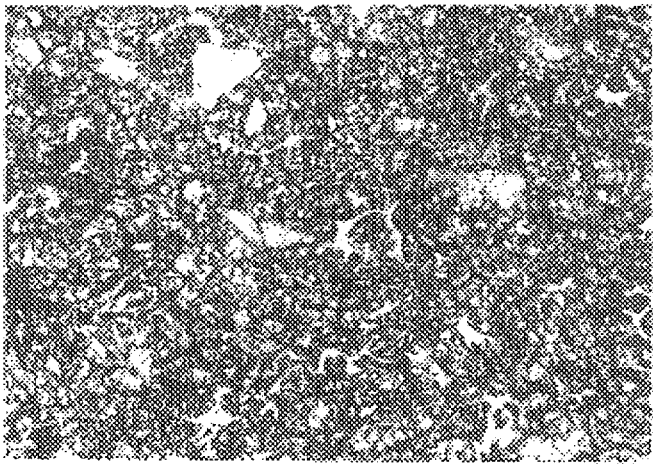
FIG. 6 is a metallographic photograph of the metallurgical structure of the sintered Fe alloy for the valve seat obtained by Experiment Example 8.
Figure 7:
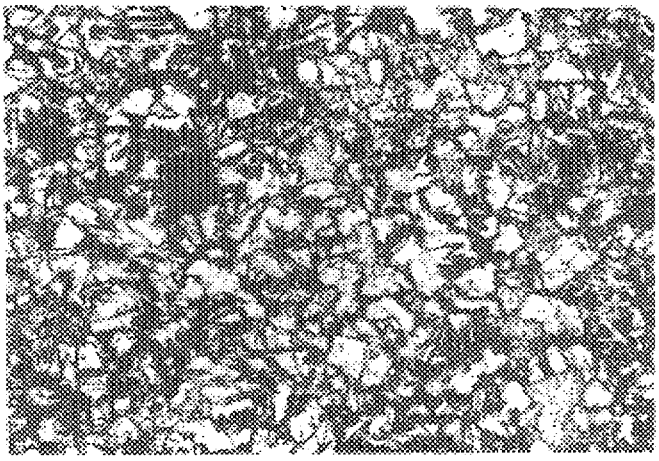
FIG. 7 is a metallographic photograph of the metallurgical structure of the sintered Fe alloy for the valve seat obtained by Experiment Example 13.
Figure 10:
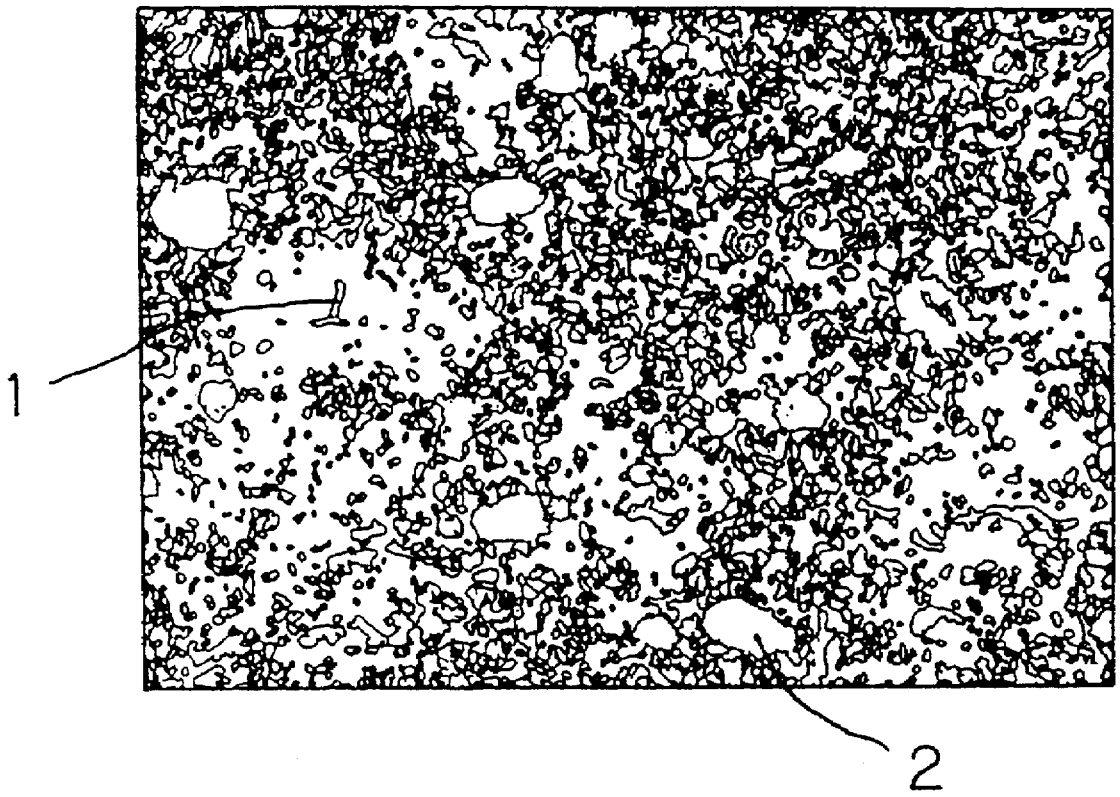
FIG. 10 is a schematic view illustrating a metallurgical structure of a sintered Fe alloy for a valve seat obtained by Experiment Example 24.
Figure 11:
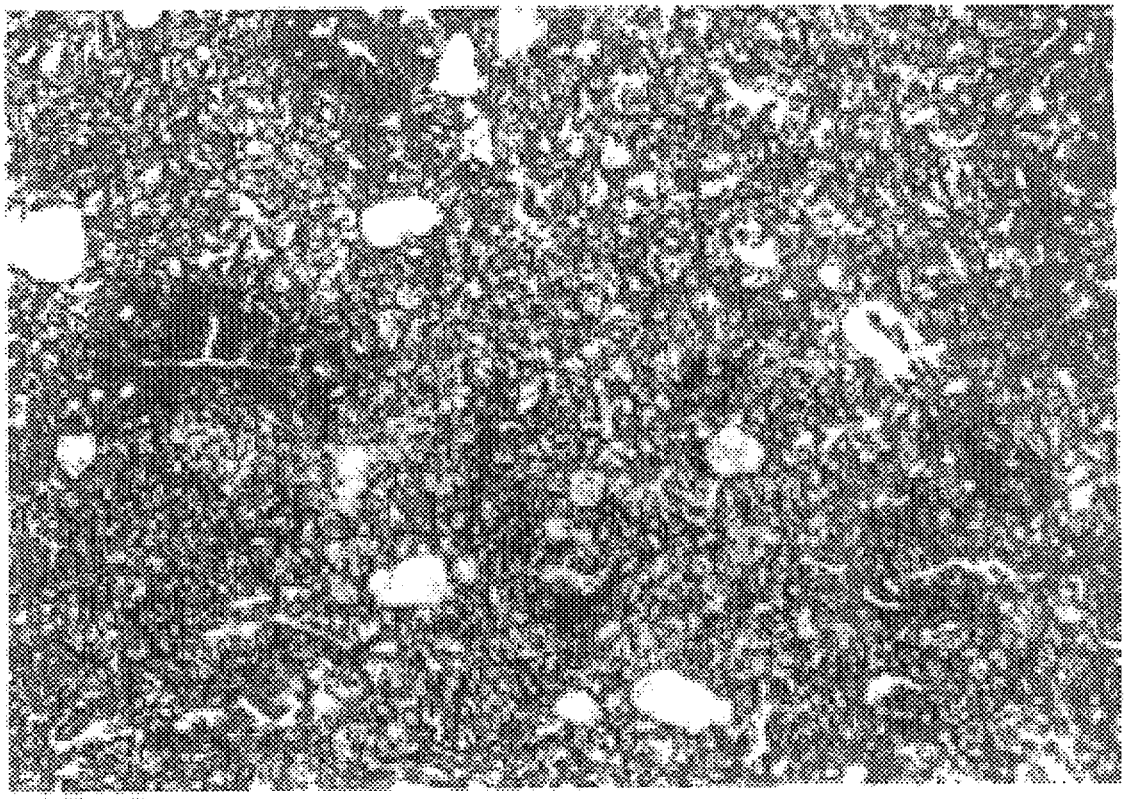
FIG. 11 is a metallographic photograph of the metallurgical structure of the sintered Fe alloy for the valve seat obtained by Experiment Example 24.
Figure 12:
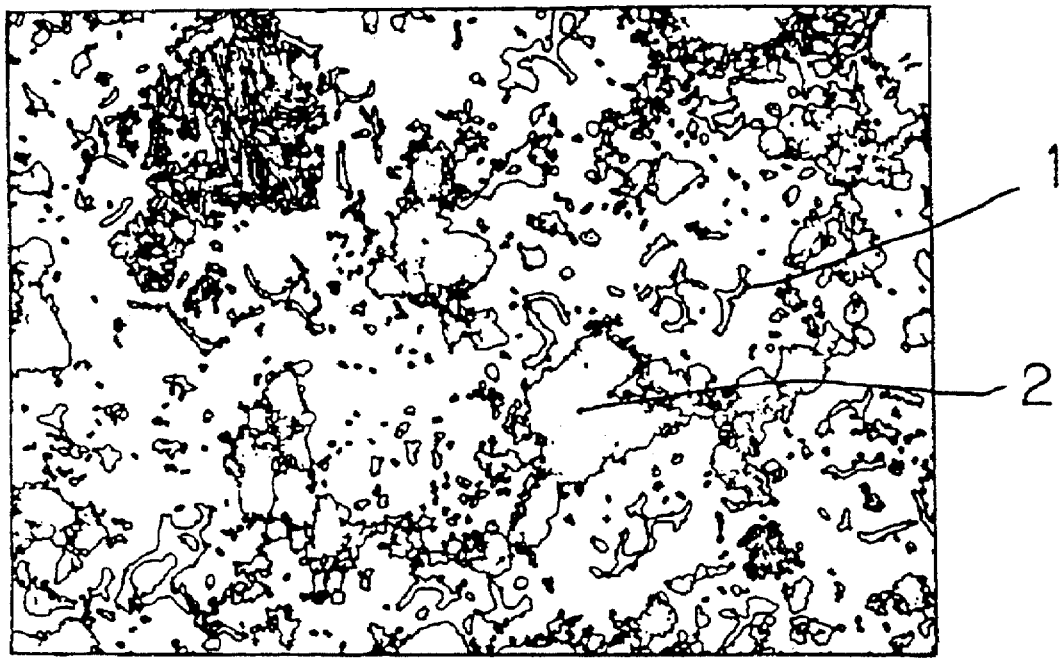
FIG. 12 is a schematic view illustrating a metallurgical structure of a sintered Fe alloy for a valve seat obtained by Experiment Example 38.
Figure 13:
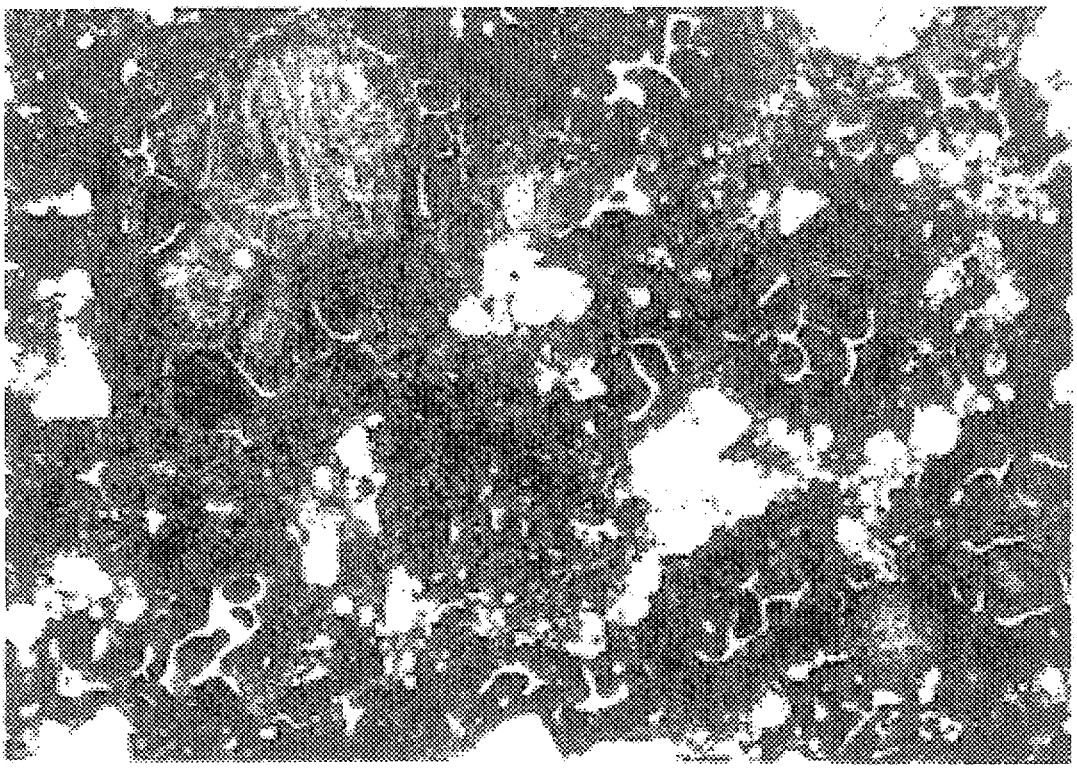
FIG. 13 is a metallographic photograph of the metallurgical structure of the sintered Fe alloy for the valve seat obtained by Experiment Example 38.

Metallurgical structures of the sintered Fe alloys obtained by Experiment Example 4, Experiment Example 8 and Experiment Example 13 are shown in FIG. 2, FIG. 3 and FIG. 4, respectively. FIG. 5, FIG. 6 and FIG. 7 show metallographic photographs (200 magnifications, etched by nital) of the metallurgical structure described above, respectively. FIG. 10 and FIG. 12 show the metallurgical structures of the sintered Fe alloys obtained by Experiment Example 24 and Experiment Example 38, respectively. FIG. 11 and FIG. 13 show metallographic photographs of the metallurgical structures described above, respectively. In above-mentioned figures, a numerical number 1 is a residual Cu, and a numerical number 2 is a hard particle.

Comparative Examples 1 to 3

A test piece of a sintered Fe alloy for the valve seat was prepared in the same manner as in the Experiment Example 1 except that the blending composition of the powdery raw material was changed on the basis of ratio as shown in Table 1-2 and Table 1-4. For the test piece obtained, tests for a density, a radial crushing strength, an amount of abrasion of the test piece and an amount of abrasion of the valve as the object member of the test piece were made in the same manner as in the Experiment Example 1. The results of the tests are shown in Table 2-2.

Comparative Example 4

A powdery raw material was blended so that a powdery Ni of 2.0 wt. %, a powdery Co of 6.0 wt. % and a hard particle of 7.0 wt. % comprising Cr is added to a powdery pure Fe. A mixed powdery alloy was blended so that zinc stearate of 1.0 wt. % as the lubricating agent for improving the mold releasing property at a time of metal mold forming is added to the powdery raw material.

The prepared mixed powdery alloy was subjected to a press forming process at a pressure of 6 ton/cm$^2$, to form a green compact body. A dewaxing treatment was carried out to the green compact body at a temperature of 450° C. for a period of time of 30 minutes, and was sintered at a temperature of 1150° C. for a period of time of 30 minutes to form a sintered body. A test piece of a sintered Fe alloy of Comparative Example 4 for a valve seat was obtained in the manner described above.

For the test piece obtained, tests for a density, a radial crushing strength, an amount of abrasion of the test piece and an amount of abrasion of the valve as the object member of the test piece were made. The results of the tests are shown in Table 2-2.

Comparative Example 5

A sintered Fe alloy for the valve seat was prepared in the same manner as in the Experiment Example 4. After that, an infiltration treatment of Cu was carried out to obtain the test piece of the sintered Fe alloy for the valve seat.

For the test piece obtained, tests for a density, a radial crushing strength, an amount of abrasion of the test piece and an amount of abrasion of the valve as the object member of the test piece were made. The results of the tests are shown in Table 2-2.

Figure 8:
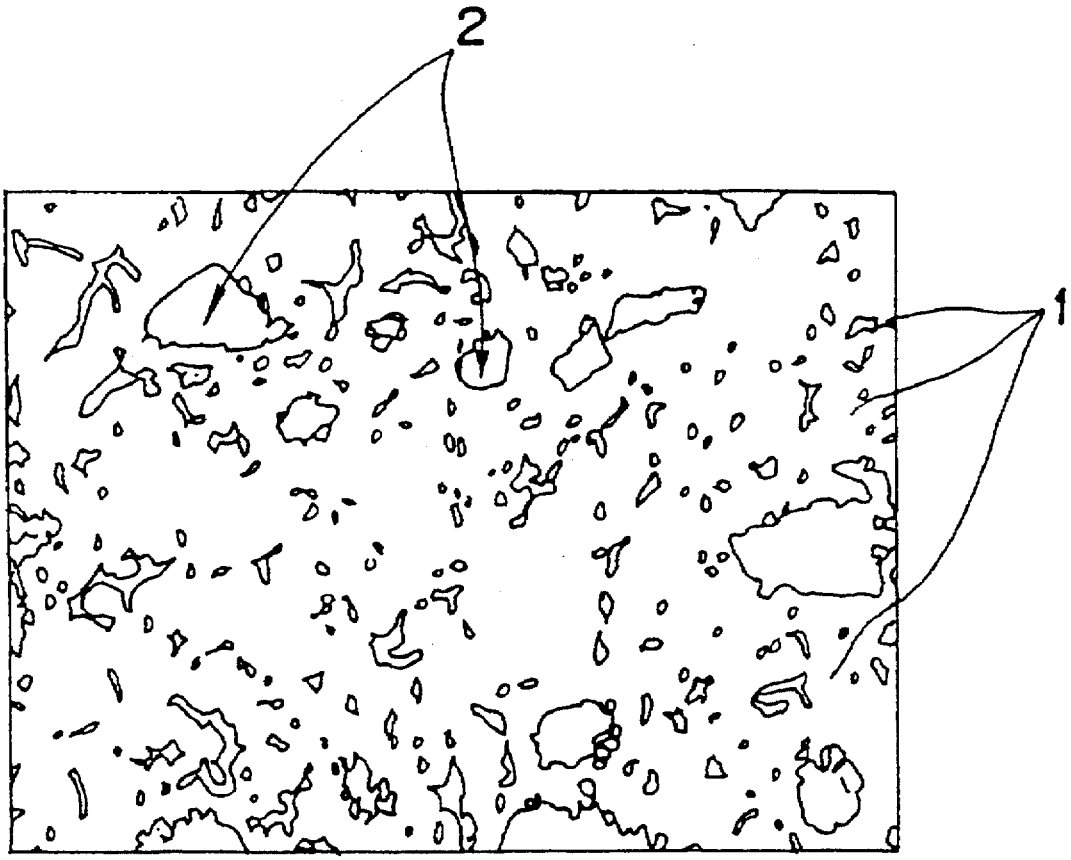
FIG. 8 is a schematic view illustrating a metallurgical structure of a sintered Fe alloy for a valve seat obtained by Comparative Example 5.
Figure 9:
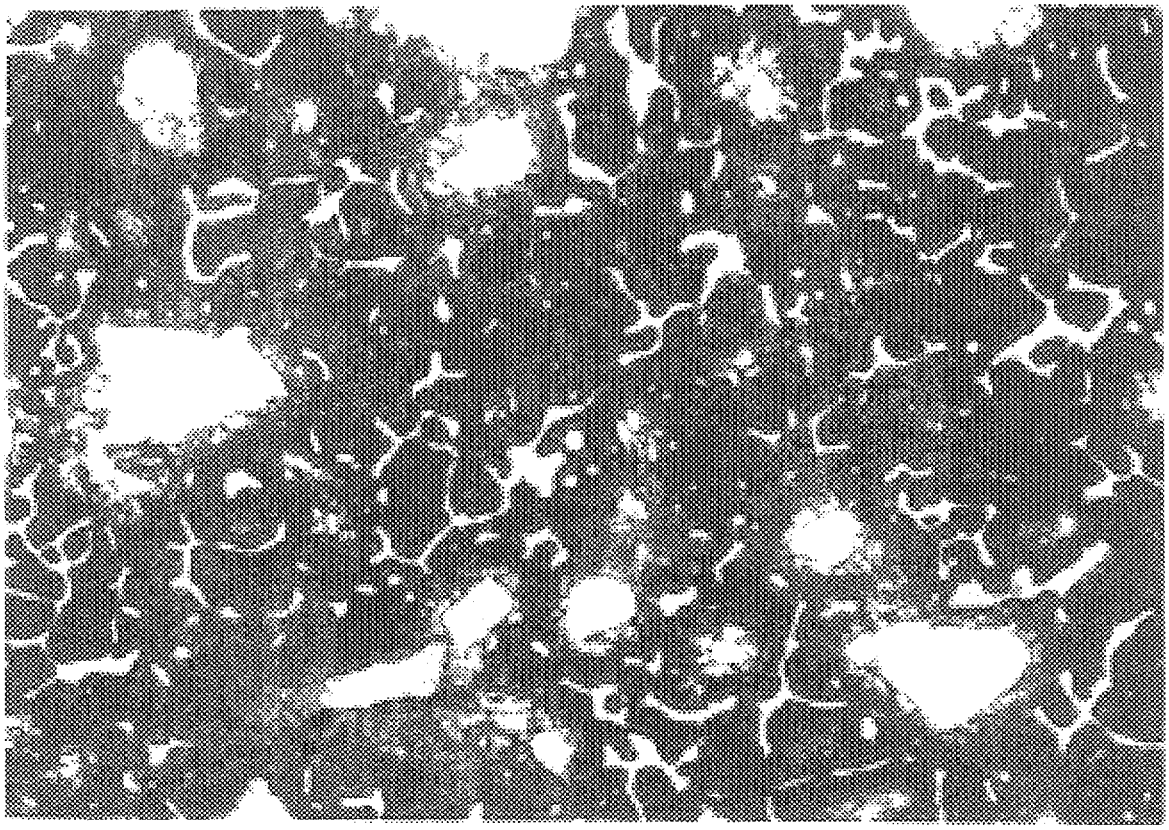
FIG. 9 is a metallographic photograph of the metallurgical structure of the sintered Fe alloy for the valve seat obtained by Comparative Example 5.

A metallurgical structure of the sintered Fe alloy obtained by Comparative Example 5 is shown in FIG. 8. FIG. 9 shows a metallographic photographs (200 magnifications, etched by nital) of the metallurgical structure described above.

Examination of the results

As is clear from Table 2-1 and Table 2-2, the amount of abrasion of each test piece and the amount of abrasion of each valve as the object member of the test piece according to Experiment Examples 1 to 40 is lower than that of each test piece and each valve according to Comparative Examples 1 to 4, thus exhibiting a sharp improvement of the abrasion resistance. Moreover, the radial crushing strength of each test piece for each valve seat according to Experiment Examples 1 to 40 is not less than that of each test piece for each valve seat according to Comparative Examples 1 to 4. Therefore, the abrasion resistance and the strength of the test piece obtained from the sintered Fe alloy of the present invention is higher than that of the test piece obtained from the conventional sintered Fe alloy.

As is clear from Table 1-2 and Table 2-2, in addition, the radial crushing strength, the amount of abrasion of each test piece and the amount of abrasion of each valve as the object member of the test piece according to Experiment Examples 1 to 40 is equal to that of the test piece and the valve according to Comparative Example 5. Therefore, each test piece for each valve seat obtained from the sintered Fe alloy of the present invention has a strength and an abrasion resistance equivalent to a sintered alloy to which an infiltration treatment of Cu is performed.

According to the present invention, the prepared powdery alloy previously containing the powdery Cu at a particular ratio is used, the sintered Fe alloy for the valve seat with the higher thermal conductivity, the high strength at a high temperature and the high abrasion resistance can be obtained without the independent infiltration treatment of Cu after the sintering treatment.

What is claimed is:

1. A sintered Fe alloy, which is utilized as a material for forming a valve seat in an internal combustion engine, and which is formed in a manner that a prepared powdery alloy is press formed by compression molding to form a green compact body which is then sintered, wherein:

said prepared powdery alloy comprises:

C: from 0.3 wt. % to 1.3 wt. %

Cu: from 5 wt. % to 20 wt. %, hard particles of at least one member selected from a ferroalloy, ceramic and intermetallic compound: from 5 wt. % to 40 wt. %, and balance a powdery Fe atomizing alloy containing from 1 wt. % to 8 wt. % of at least one member selected from Cr and Mo wherein the Cu component is contained in the sintered Fe alloy as residual Cu.

2. A sintered Fe alloy as claimed in claim 1, wherein:

said balance being said powdery Fe atomizing alloy further comprises:

at least one member selected from Ni of 4 wt. % or below, W of 4 wt. % or below, V of 4 wt. % or below, Mn of 1 wt. % or below, Ti of 1 wt. % or below and B of 1 wt. % or below, and a total content of said at least one member is 5 wt. % or below with respect to the total weight of said sintered Fe alloy.

3. A sintered Fe alloy, which is utilized as a material for forming a valve seat in an internal combustion engine, and which is formed in a manner that a prepared powdery alloy is press formed by compression molding to form a green compact body which is then sintered, wherein:

said prepared powdery alloy comprises:

C: from 0.3 wt% to 1.6 wt. %,

Cu: from 5 wt. % to 20 wt. %, hard particles of at least one member selected from a ferroalloy, ceramic and intermetallic compound: from 5 wt. % to 40 wt. %, and balance a powdery Fe atomizing alloy which comprises a powdery atomizing alloy containing Co of from 1 wt. % to 10 wt. %.

4. A sintered Fe alloy as claimed in claim 3, wherein:

said balance being said powdery Fe atomizing alloy further comprises:

at least one member selected from Ni of 4 wt. % or below, W of 4 wt. % or below, V of 4 wt. % or below, Mn of 1 wt. % or below, Ti of 1 wt. % or below and B of 1 wt. % or below, and a total content of said at least one member is 5 wt. % or below with respect to the total weight of said sintered Fe alloy.

5. A sintered Fe alloy as claimed in claim 1, wherein:

said hard particle comprises Fe-Mo of 10 wt. % or above as ferroalloy.

6. A sintered Fe alloy as claimed in claim 3, wherein:

said hard particle comprises Fe-Mo of 10 wt. % or above as ferroalloy.

7. A sintered Fe alloy as claimed in claim 1, wherein:

said sintered Fe alloy has a density of 7.0 g/cm$^3$ or above.

8. A sintered Fe alloy as claimed in claim 3, wherein:

said sintered Fe alloy has a density of 7.0 g/cm$^3$ or above.

* * * * *